United States Patent [19]

Smith

[11] 4,434,848

[45] Mar. 6, 1984

[54] MAXIMIZING FRACTURE EXTENSION IN MASSIVE HYDRAULIC FRACTURING

[75] Inventor: Michael B. Smith, Tulsa, Okla.

[73] Assignee: Standard Oil Company, Chicago, Ill.

[21] Appl. No.: 332,026

[22] Filed: Dec. 18, 1981

Related U.S. Application Data

[63] Continuation of Ser. No. 168,829, Jul. 10, 1980, abandoned.

[51] Int. Cl.[3] ..... E21B 43/26; E21B 47/06

[52] U.S. Cl. ..... 166/250; 166/308

[58] Field of Search ..... 166/308, 177, 249, 280, 166/271, 259, 250

[56] References Cited

U.S. PATENT DOCUMENTS

| | | | |
|---|---|---|---|
| 2,915,122 | 12/1959 | Hulse | 166/308 X |
| 3,048,226 | 8/1962 | Smith | 166/308 |
| 3,136,361 | 6/1964 | Marx | 166/308 |
| 3,302,720 | 2/1967 | Brandon | 166/249 |
| 3,743,017 | 7/1973 | Fast et al. | 166/308 X |
| 3,851,709 | 12/1974 | Fitch et al. | 166/308 |
| 3,933,205 | 1/1976 | Kiel | 166/308 |
| 3,948,325 | 4/1976 | Winston et al. | 166/308 |
| 3,965,982 | 6/1976 | Medlin | 166/308 X |
| 4,186,802 | 2/1980 | Perlman | 166/308 |

*Primary Examiner*—Stephen J. Novosad

*Attorney, Agent, or Firm*—Scott H. Brown; Fred E. Hook

[57] ABSTRACT

During fracture treatment of a subterranean formation, multiple hydraulic fracturing cycles are performed wherein the bottomhole treating pressure of a wellbore is controlled to not exceed a maximum bottomhole treating pressure for the formation, thereby attaining maximum principle fracture extension and limiting initiation of secondary fractures transverse to the principle fracture extension.

9 Claims, 2 Drawing Figures

MAXIMIZING FRACTURE EXTENSION IN MASSIVE HYDRAULIC FRACTURING

This is a continuation of application Ser. No. 168,829, filed July 10, 1980, now abandoned.

BACKGROUND OF THE INVENTION

1. Field of the Invention

The method of this invention relates to hydraulic fracturing of subterranean formations by a fracturing fluid. Particularly, this invention relates to control of hydraulic fracturing treatments of tight gas sands.

2. Setting of the Invention

Oil and gas accumulations usually occur in porous and permeable underground rock formations. In order to produce the oil and gas contained in a formation, a well is drilled into the formation. The oil and gas may be contained in the porosity or pore spaces of the formation hydraulically connected by means of permeability or interconnecting channels between the pore spaces. After the well is drilled into the formation, oil and gas are displaced to the wellbore by means of fluid expansion, natural or artificial fluid displacement, gravity drainage, capillary expulsion, etc. These various processes may work together or independently to remove the hydrocarbons in the wellbore to existing flow channels. In many instances, however, production of the well may be impaired by drilling fluids that enter into and plug the flow channels, by insufficient natural channels leading to the particular borehole, of by insufficient permeability surrounding the borehole which may result in a noncommercial well. The problem then becomes one of treating the formation in a manner which will increase the ability of the formation rock to conduct fluid to the wellbore.

Various methods of hydraulically fracturing a formation to increase the conductivity of the formation have been developed. Hydraulic fracturing may be defined as the process in which fluid pressure is applied to exposed formation rock until total failure or fracturing occurs. After failure of the formation rock, a sustained application of fluid pressure extends the crevice or fracture outward from the point of failure. The fracture, propped by a proppant, creates high capacity flow channel and exposes new surface area along the fracture. However, the height of such a fracture should be confined to the zone of interest. No methods are presently available to limit this height.

3. Relevant Publications

A U.S. Pat. No. 3,933,205, Othar Meade Kiel, issued Jan. 20, 1976 and entitled "Hydraulic Fracturing Processing Using Reverse Flow" discloses a method of multiple hydraulic fracturing cycles. The disadvantage to the method of Kiel is that a predetermined amount of the fracture fluid is broken up into multiple treatments to obtain and initiate secondary fractures transverse to the principle fracture. In the method of this invention, it is desirable to create deeply penetrating fractures which are confined to the producing horizon. In order that this may be accomplished, the initiation of secondary fractures or fractures extending into horizons above or below the producing horizon must be minimized.

SUMMARY OF THE INVENTION

By this invention, a method is described for hydraulic fracturing a formation, the fracturing treatment including (a) injecting a fluid into the formation until the bottomhole treating pressure equals maximum bottomhole treating pressure, (b) discontinuing the injection for a predetermined period of time, (c) measuring the bottomhole treating pressure, repeating steps (a), (b), and (c) sequentially until the measured bottomhole treating pressure amounts to at least 90% of the maximum bottomhole treating pressure.

Additionally, a method is described for hydraulic fracturing a formation, the fracturing treatment including (a) alternately injecting a fluid into the formation until the bottomhole treating pressure equals the maximum bottomhole treating pressure, (b) followed by discontinuing the injection until the bottomhole pressure is reduced to a level below the maximum bottomhole treating pressure until bottomhole treating pressure at the end of the period of time when the pumping is discontinued amounts to at least 90% of the maximum bottomhole treating pressure. By this method a fracture can be extended to greater lengths into a producing horizon without initiating secondary fractures or extending the fracture into horizons above or below the producing horizons.

DETAILED DESCRIPTION OF THE INVENTION

Figure 1:
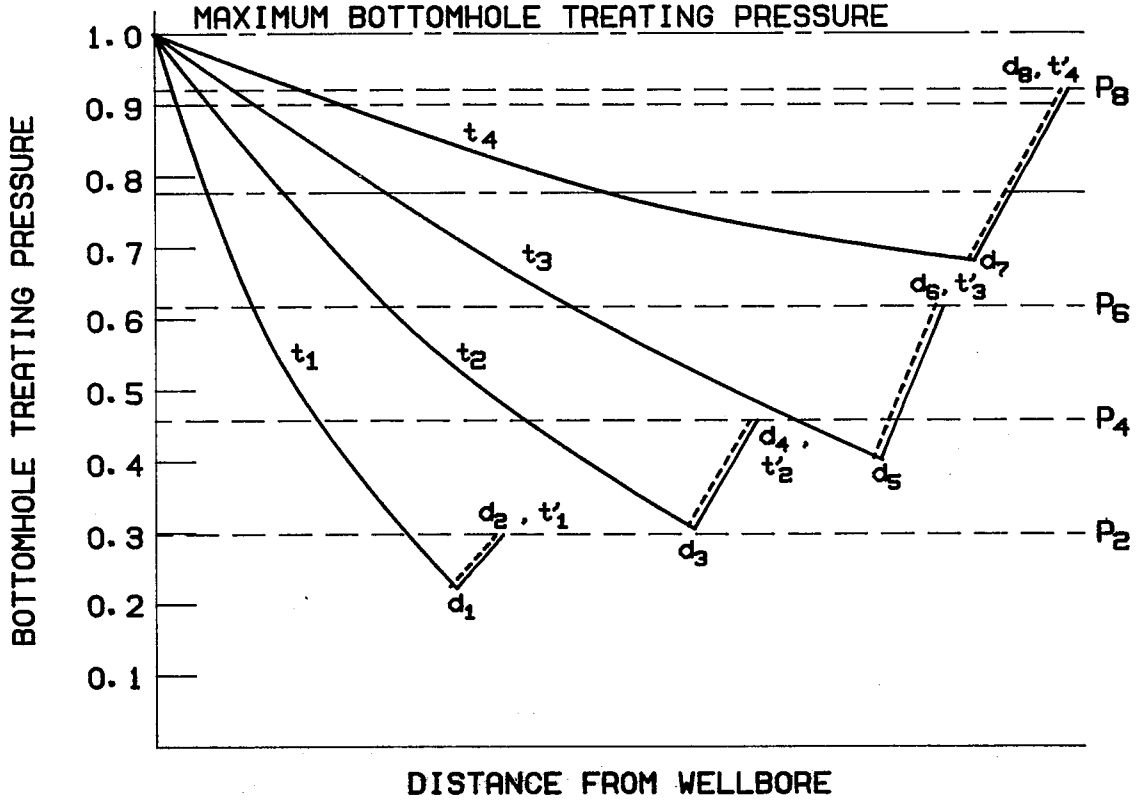
FIG. 1 is a graph showing bottomhole treating pressure versus distance from the wellbore.
Figure 2:
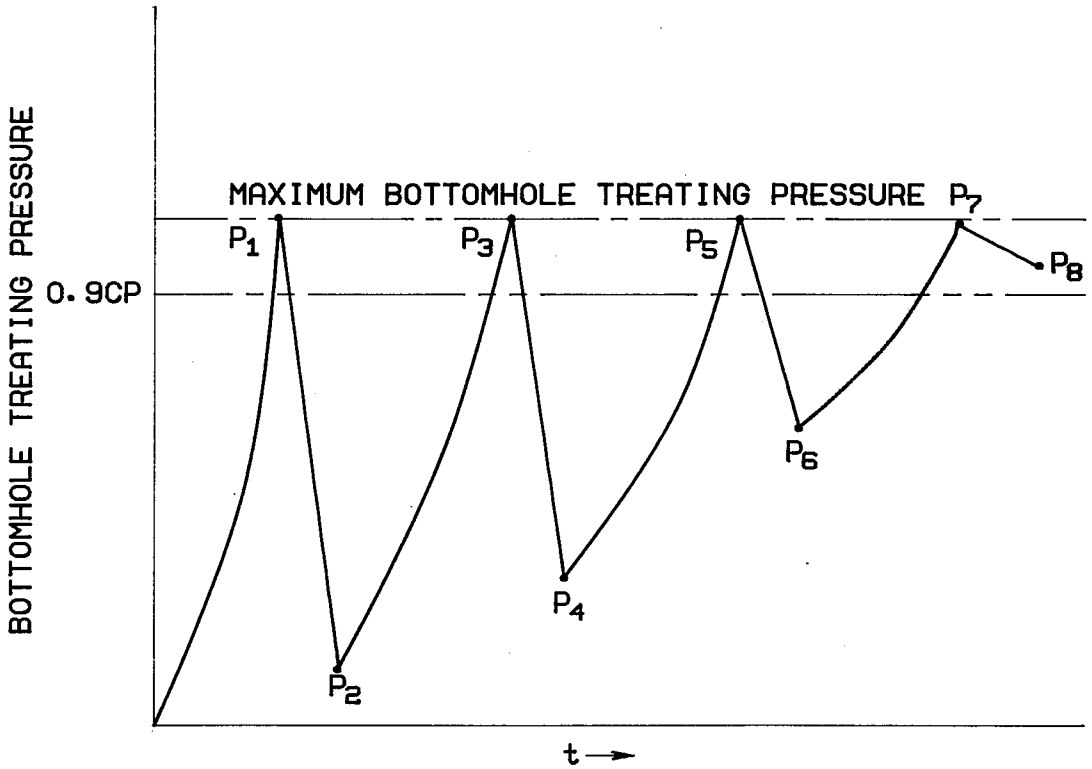
FIG. 2 is a graph showing bottomhole treating pressure versus time.

In fracturing stimulation of tight gas sands, the primary goal is to create deep penetrating fractures which are confined to the producing horizon. The success of a stimulation will depend upon how well the adjacent zones confine a fracture. This in turn will depend upon the mechanical properties and the thickness of the adjacent zones relative to the zone of interest being fractured. However, if the injection pressure of the fracturing fluid becomes too high, the fracture may cross the boundaries out of the zone of interest and begin to extend vertically into the adjacent zones. In other formations high fracturing pressure can open fractures perpendicular to the primary fracture, thereby terminating the extension of the primary fracture into the production horizon.

In accordance with this invention, it has been found that multiple fracturing cycles where the fracturing pressure is controlled to not exceed a pressure at which undesirable fracturing occurs will bring about maximum primary fracture growth to the exclusion of secondary fractures or the extension of fractures into undesirable horizons either above or below the formation of interest.

In operation of the present invention, the bottomhole pressure is maintained at a level below the maximum bottomhole treating pressure and the treatment is conducted by alternately injecting fluid into the fracture followed by shutting the well in.

In preparation for the present invention, a formation is initially fractured by applying pressure via a wellbore on its exposed surfaces with a fracturing fluid until fracture results. Any fracturing fluid may be used for accomplishing initial fracturing of the formation.

After the fracture is formed in the formation, a quantity of fluid is pumped into the fracture at a pressure equal to or greater than the pressure required to extend a fracture through the formation.

The pumping pressure is increased to a bottomhole pressure $P_1$ at $t_1$, $P_1$ being not greater than the maximum bottomhole treating pressure, at which reduced fracture extension rate occurs.

The maximum bottomhole treating pressure is the maximum pressure which a formation should be subjected to during the formation of a fracture and is the pressure at the entrance to the fracture as measured inside the casing or inferred by methods known to persons skilled in the art of hydraulic fracturing.

The bottomhole treating pressure is used as opposed to the surface injection pressure due to the pressure differences caused by viscosity and/or large fluid friction losses in the tubing or casing.

The maximum bottomhole treating pressure is determined by actual field tests and comprises the following: (a) extending a fracture into the formation from a second wellbore extending into the formation by injecting fluid into the fracture at a rate sufficient for extending the fracture into the formation until the change in the bottomhole treating pressure is substantially zero during the injection of the fluid, (b) then measuring at the second wellbore the bottomhole treating pressure, (c) determining the bottomhole treating pressure at which the change in the bottomhole treating pressure during the formation of the fracture extending from the second wellbore is substantially zero, and (d) taking the sum of the determined bottomhole treating pressure less the in situ closure stress of the formation at the second wellbore plus the in situ closure stress of the formation at the first wellbore extending into the formation, which equals the maximum bottomhole treating pressure which should be attained during the fracturing of the formation at the first wellbore.

The above described method of determining the maximum bottomhole treating pressure is disclosed within copending application to Nolte and Smith for "Determination of Maximum Fracture Pressure," Ser. No. 251,666 filed Apr. 6, 1981.

Other methods of determining the maximum bottomhole treating pressure include mechanical tests on core samples or field experience in the area.

As shown in FIG. 1, the fracture has extended $d_1$ feet into the formation from the wellbore. Pumping is then discontinued and the bottomhole pressure decreases with time. It is thought that this is due to the increased fluid density in the fracture which is due to fluid leakoff and additional fracture volume created by fracture extension due to pressure equalization at the fracture tip.

At the time the pumping is discontinued, the pressure at the tip is greater than that needed to propagate the fracture while the pressure at the bottom of the wellbore remains at or below the maximum bottomhole treating pressure.

The pumping is discontinued for a predetermined period of time which allows the bottomhole pressure and the pressure along the fracture to equalize to $P_2$ and the fracture to extend to $d_2$ feet from the wellbore at $t_1'$.

An additional quantity of fracturing fluid is then pumped into the fracture. The pumping pressure increases with time to bottomhole pressure, $P_3$ at $t_2$ when the pumping is discontinued. Pressure $P_3$ does not exceed the maximum bottomhole treating pressure. The fracture extends to $d_3$ feet from the wellbore into the formation.

The pumping is again discontinued for a predetermined period of time which allows the bottomhole and fracture pressures to equalize to $P_4$ and the fracture to extend to $d_4$ feet from the borehole at $t_2'$.

Additional quantities of fracturing fluid are then pumped into the fracture. The pumping pressures increase with time to bottomhole pressures $P_5$ and $P_7$ at $t_3$ and $t_4$ respectively when the pumping is discontinued. The pumping is discontinued for a predetermined period of time which allows the pressure to equalize to $P_6$ and $P_8$ and the fracture to extend to $d_6$ and $d_8$ feet from the wellbore, at times $t_3'$ and $t_4'$ respectively.

The cycles of injection and discontinued pumping continues until the bottomhole treating pressure at the end of the period of discontinued pumping, $P_2$, very nearly equals the maximum bottomhole treating pressure. Theoretically, the cycles could be repeated an infinite number of times until the equilibrium fracture pressure equals the reduced fracture extension rate pressure. Preferably, however, the cycles are discontinued when the bottomhole pressure at the end of period during which pumping is discontinued equals 90% of the maximum bottomhole treating pressure.

The last cycle should be followed by an injection of a displacing fluid without proppant in order to extend the proppant into the newly created fracture volume. This final injection should serve also to flush the casing.

Preferably, the fracturing fluid is designed so that the proppant is not allowed to settle during the periods when pumping is discontinued. A fracturing fluid having a viscosity in excess of 10 centipoise is preferred More preferably, the fluid has a viscosity in excess of 10 centipoise but still in the pumpable range. Preferably the fluid is not thioxtropic. Also, preferably, a propping agent is included in the fluid. Suitable propping agents include sand, walnut hulls, glass beads, etc.

The shut-in periods, that is, the periods in which equilibrium pressure is allowed to be attained should be between half a minute and half an hour. Preferably, however, the shut-in periods should be between one and five minutes.

The present invention, therefore, is well adapted to carry out the objects and attain the ends and advantages mentioned, as well as those inherent therein. While presently preferred embodiments of the invention are given for the purpose of disclosure, numerous changes can be made which will readily suggest themselves to those skilled in the art, and which are encompassed within the spirit of the invention disclosed herein.

I claim:

1. A method for fracturing a subterranean formation, comprising:

(a) injecting a fracturing fluid into said formation under fracture extending conditions until the bottomhole treating pressure approaches a maximum bottomhole treating pressure for said formation;

(b) discontinuing said injection of said fracturing fluid for a period of time (t) to allow the bottomhole treating pressure and the pressure along the created fracture to equalize; and (c) sequentially repeating steps (a) and (b) until the bottomhole treating pressure very nearly equals the maximum bottomhole treating pressure.

2. A method for fracturing a subterranean formation through a wellbore, comprising:

(a) injecting a fracturing fluid into said formation under fracture extending conditions until the bottomhole treating pressure approaches a maximum bottomhole treating pressure for said formation;

(b) discontinuing said injection of said fracturing fluid for a period of time (t) to allow the bottomhole treating pressure and the pressure along the created fracture to equalize; and (c) sequentially repeating steps (a) and (b) until the bottomhole treating pressure amounts to at least 90% of said maximum bottomhole treating pressure.

3. A method for fracturing a subterranean formation through a wellbore, comprising:

(a) injecting a fracturing fluid into said formation under fracture extending conditions until the bottomhole treating pressure equals a maximum bottomhole treating pressure for said formation;

(b) discontinuing said injection of said fracturing fluid for a period of time (t) to allow the bottomhole treating pressure and the pressure along the created fracture to equalize; and (c) sequentially repeating steps (a) and (b) until the bottomhole treating pressure equals the maximum bottomhole treating pressure.

4. A method as in claim 1, 2 or 3 wherein the bottomhole treating pressure is measured while injecting said fracturing fluid.

5. A method as in claim 1, 2 or 3 wherein time (t) is between 0.5 and 30.0 minutes.

6. A method as in claim 1, 2 or 3 wherein time (t) is between 1.0 and 5.0 minutes.

7. A method as in claim 1, 2 or 3 wherein said fracturing fluid contains proppants.

8. A method as in claim 7 wherein after step (c) a displacing fluid is injected into said formation.

9. A method as in claim 1, 2 or 3 wherein said fracturing fluid has a viscosity of at least 10 cp.

* * * * *